US005176279A

United States Patent [19]

Campbell et al.

[11] Patent Number: 5,176,279

[45] Date of Patent: Jan. 5, 1993

[54] CONTAINER CAP

[75] Inventors: Paul Campbell, Pearcedale; Dieter Dehn, Doveton; John C. Woodlock, Rye, all of Australia

[73] Assignee: Australian Stamping Foils Pty. Ltd., Moorabbin, Australia

[21] Appl. No.: 671,902

[22] PCT Filed: Aug. 15, 1990

[86] PCT No.: PCT/AU90/00350

§ 371 Date: Mar. 18, 1991

§ 102(e) Date: Mar. 18, 1991

[87] PCT Pub. No.: WO91/02686

PCT Pub. Date: Mar. 7, 1991

[30] Foreign Application Priority Data

Aug. 15, 1989 [AU] Australia ..... PJ5773

[51] Int. Cl.[5] ..... B65D 17/40

[52] U.S. Cl. ..... 220/276; 220/270; 220/724

[58] Field of Search ..... 220/85 P, 266, 270, 220/276, 724; 215/249, 254, 256

[56] References Cited

U.S. PATENT DOCUMENTS

| | | | |
|---|---|---|---|
| 3,937,349 | 2/1976 | Hsu . | |
| 4,030,630 | 6/1977 | Yealy | 220/258 |
| 4,165,014 | 8/1979 | Ruseitti | 220/266 |
| 4,285,442 | 8/1981 | Wedzik | 220/270 |
| 4,457,445 | 7/1984 | Hanks et al. | 220/214 |
| 4,607,759 | 8/1986 | Boetzkes | 220/266 |
| 4,705,188 | 11/1987 | Rahn | 220/367 |
| 4,779,750 | 10/1988 | Armstrong . | |
| 4,942,977 | 7/1990 | Hidding | 220/276 |

FOREIGN PATENT DOCUMENTS

| | | |
|---|---|---|
| 42201 | 5/1985 | Australia . |
| 82691 | 7/1988 | Australia . |
| 2622722 | 5/1989 | France . |
| 1415466 | 11/1975 | United Kingdom . |
| 2211830 | 7/1989 | United Kingdom . |
| 9000350 | 3/1991 | World Int. Prop. O. . |

*Primary Examiner*—Allan N. Shoap
*Assistant Examiner*—Nova Stucker
*Attorney, Agent, or Firm*—Bell, Seltzer, Park & Gibson

[57] ABSTRACT

A cap for fitment to a closure neck of a container, such as a beer keg to cover the dispensing valve therein, said cap having a cover portion and a skirt portion, said skirt portion including a snap-fit means for fitting the cap to said neck, said cover portion including at least one line of weakness and a depressible tab portion, such that upon depression of said tap portion the cover portion is at least partially separated to allow detachment of the cap from the neck portion.

4 Claims, 1 Drawing Sheet

CONTAINER CAP

FIELD OF THE INVENTION

The present invention relates to the field of container caps. In particular, the present invention relates to a cap or cover protector used in association with a container. The present invention, in one specific form, relates to a cap or cover for a beer keg.

DEFINITION OF TERMS

Throughout the specification, the term "cap" includes a cover, seal or plug or other means for protecting or sheltering.

BACKGROUND ART

U.S. Pat. No. 3,937,349 discloses a crown cap for a bottle having a pull tab thereon which is pulled to separate the cap and remove the cap from the bottle.

G.B. 1,415,466 discloses a cap for a beer keg having a pull tab thereon which is pulled to fracture the skirt of the cap to enable removal of the cap from a beer keg.

U.S. Pat. No. 4,779,750 discloses a cap for a beer keg having a pull tab thereon which is pulled to separate the cap thus enabling removal of the cap from the beer keg.

Australian Patent Application No. 42201/85 discloses a similar cap to that of U.S. Pat. No. 4,779,750.

Often, pull tabs of the prior art are difficult to grasp with a user's fingers, do not tear the cap as desired to cause removal of the cap and/or break-off mid-way through the pulling action, thereby rendering the cap difficult to, and in some cases not, removable.

With regard to a beer keg cap disclosed in U.S. Pat. No. 4,779,750, in particular, problems have been encountered in the use of the cap.

Many brewing companies utilise automation techniques in filling beer kegs and providing a keg cap or seal on the filled keg. It has been found that due to the openness of the exposed pull tab of U.S. Pat. No. 4,779,750, interlocking of two caps can occur in a hopper feeding the automatic keg capping machinery. This may cause a blockage in the feeding hopper. Alternatively, parts of the interlocked caps may lead to undesirable fracture and separation as the caps are disengaged.

Furthermore, due to the overall design of the cap and the material from which the cap is manufactured, when the pull tab is pulled, the majority of the cap does not always separate into two halves. The pull tab itself may break in half, thus rendering removal of the cap more difficult. Breakage of the cap into a number of pieces may also create a litter problem.

Additionally, the cap disclosed in U.S. Pat. No. 4,779,750 uses a plurality of tear lines to define the pull tab. Upon pulling the tab, extra force must be exerted in order to fracture at least two lines of weakness. This extra force, in turn, may lead to a breakage of the pull tab itself, rather than separation of the cap from the keg.

OBJECTS OF THE INVENTION

It is an object of the present invention to alleviate at least some of the disadvantages of the prior art.

A further object of the present invention is to provide a cap in which removal thereof from a container is initiated or effected by a depressing action.

Yet a further object of the present invention is to provide a cap which can provide an indication of whether the cap or container has been tampered with.

Still a further object of the present invention is to provide a cap having fewer lines of weakness therein.

SUMMARY OF INVENTION

The present invention provides a cap for fitment to a closure neck of a container, such as a beer keg to cover the dispensing valve therein, said cap having a cover portion and a snap-fit means for attaching the cap to said neck, said cover portion including at least one line of weakness and a depressible tab portion, such that upon depression of said tab portion the cover portion is at least partially separated to allow detachment of the cap from the neck portion.

Utilising a depressible tab portion achieves several advantages. For example, with the push tab of the present invention there is no need to obtain a firm grip of the depression tab as no pulling action is required. This avoids breakage of the pull tab. Furthermore, upon a depression force being applied to the cap of the present invention, the user's finger is able to engage the cap itself to enable easy separation and removal of at least a portion of the cap such that access can be had to the container rather than engaging a pull tab. This provides for more reliable fracturing of the cap. Also, one line of Weakness provides for reduced effort in separating the cap of the present invention.

Preferred embodiments of the present invention will now be herein described with reference to the accompanying drawings, wherein.

Figure 1:
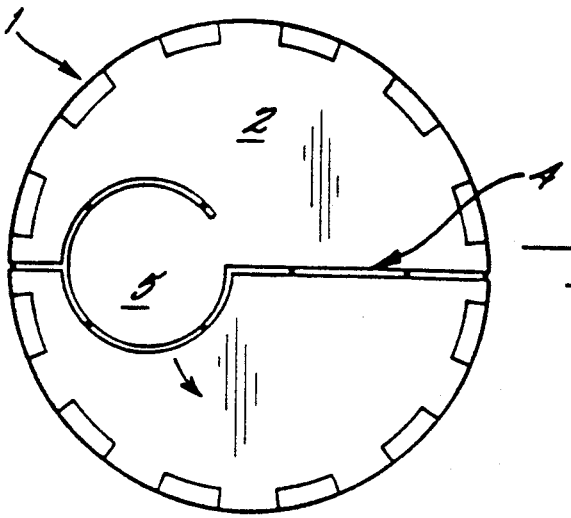
FIG. 1 shows an intact cap according to a preferred embodiment of the present invention.

With regard to the drawings, the present invention provides a cap 1 for fitting to a closure neck of a beer keg (not shown) to cover a dispensing valve therein. The cap includes a cover portion 2 and a shirt portion 9 having snap-fit means 3 for attaching the cap to the neck. The cover portion includes a line of weakness 4 and a depressible tab portion 5. The snap fit means include inwardly directed lugs 10 which serve to engage the closure neck of a beer keg.

Figure 2:
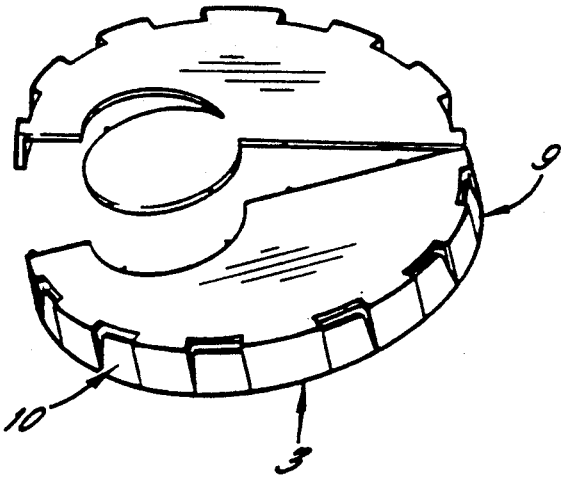
FIG. 2 shows a cap according to a preferred embodiment of the present invention fractured to enable removal of the cap from attachment to a container.

As shown in FIG. 2, when the tab 5 is depressed, say by a user's finger, the finger can thereafter engage and pull the cover portion so that the cap separates (at least partially) along the line of weakness. The cap may be pulled laterally or upwardly to cause the separation. This enables the cover to be removed from the beer keg neck. When the cap has been broken, it also provides an indication that the cap, container and/or its contents have been tampered with.

Figure 3:
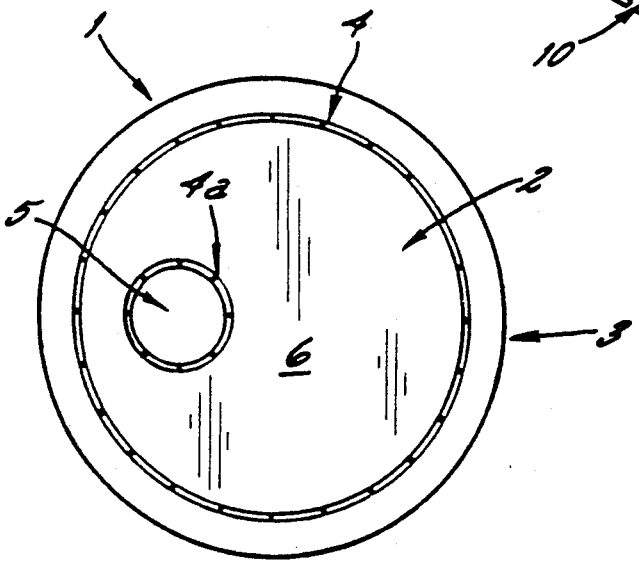
FIG. 3 shows an alternative embodiment of the present invention.

In the embodiment shown in FIGS. 1 and 2, the depressible tab is defined by the line of weakness about which the cap can be separated. An alternative embodiment as shown in FIG. 3, shows a cap 1 having lines of weakness 4,4*a* on the cover portion. When tab 5 is depressed, the user's finger can engage removable disc portion 6. The user can then tear away the disc 6 to allow access to under the cover. Thus, part of the cover portion is removed while retaining the snap-fit means 3 attached to the container (not shown).

It will be appreciated that the feature of depressing the tab 5 reduces the apparent difficulties experienced with known pull tabs and reduces the risk of damage to a user's finger or fingernail.

Other variations are contemplated within the scope of the present invention, all of which are to be hereby encompassed within the scope of the appended claims.

We claim:

1. A cap for fitment to a closure neck of a container, such as a beer keg to cover the dispensing valve therein, said cap including a generally flat cover portion having a generally circular periphery, and an annular skirt portion depending from said circular periphery of said cover portion, said skirt portion including snap-fit means for fitting the cap to the closure neck, said cap further including at least one continuous line of weakness extending completely across said cover portion and substantially through at least one side of said annular skirt portion, with said at least one line of weakness including (a) a first portion which extends linearly along a diameter of the circular periphery of said cover portion and along at least a major portion of the length of such diameter, and (b) a second portion, and a depressible tab portion formed in said cover portion, with said tap portion having an edge which is defined at least in part by said second portion of said at least one line of weakness and being depressible in a direction perpendicular to said cover portion, such that upon downward depression of said tap portion the cap is at least partially separated along said line of weakness to allow detachment of the cap from the closure neck.

2. The cap as defined in claim 1 wherein said second portion of said at least one line of weakness is arcuately curved and forms about one half of a circle.

3. The cap as defined in claim 2 wherein said edge of said depressible tap portion is further defined by an additional line of weakness, with said additional line of weakness and said second portion of said at least one line of weakness together forming a substantially complete circle.

4. A cap for fitment to a closure neck of a container, such as a beer keg to cover the dispensing valve therein, said cap including a generally flat cover portion having a generally circular periphery, and an annular skirt portion depending from said circular periphery of said cover portion, said skirt portion including a snap-fit means for fitting the cap to said neck, said cap further including a first line of weakness extending along a complete circle on said cover portion which is immediately adjacent said annular skirt, and a depressible tab portion formed in said cover portion within said circular first line of weakness and with said tap portion being defined by a second substantially circular line of weakness, and such that said tap portion may be downwardly depressed to facilitate severance of said cover along said first line of weakness.

* * * * *